US010800063B2

(12) United States Patent
Larsson-Hall

(10) Patent No.: US 10,800,063 B2
(45) Date of Patent: Oct. 13, 2020

(54) CUTTING KNIFE MONITORING SYSTEM FOR A FILLING MACHINE

(71) Applicant: Tetra Laval Holdings & Finance S.A., Pully (CH)

(72) Inventor: Clas Larsson-Hall, Kävlinge (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 47 days.

(21) Appl. No.: 16/061,006

(22) PCT Filed: Dec. 14, 2016

(86) PCT No.: PCT/EP2016/081037
§ 371 (c)(1),
(2) Date: Jun. 11, 2018

(87) PCT Pub. No.: WO2017/102864
PCT Pub. Date: Jun. 22, 2017

(65) Prior Publication Data

US 2018/0281219 A1 Oct. 4, 2018

(30) Foreign Application Priority Data

Dec. 18, 2015 (SE) ..... 1551679

(51) Int. Cl.

| | |
|---|---|
| ***B26D 5/04*** | (2006.01) |
| ***B65B 61/06*** | (2006.01) |
| ***B26D 5/12*** | (2006.01) |
| *B65B 9/10* | (2006.01) |

(52) U.S. Cl.
CPC ..... *B26D 5/04* (2013.01); *B26D 5/12* (2013.01); *B65B 61/06* (2013.01); *B65B 9/10* (2013.01)

(58) Field of Classification Search
CPC ..... B26D 5/04; B26D 5/02; B26D 5/12
See application file for complete search history.

(56) References Cited

FOREIGN PATENT DOCUMENTS

| | | |
|---|---|---|
| EP | 1 666 362 A1 | 6/2006 |
| EP | 1 674 397 A1 | 6/2006 |

OTHER PUBLICATIONS

International Search Report and Written Opinion from corresponding PCT Application No. PCT/EP2016/081037 dated Mar. 27, 2017 (12 pages).
Office Action from corresponding Swedish Application No. 1551679-2 dated Jul. 12, 2016 (5 pages).

*Primary Examiner* — Jennifer B Swinney
(74) *Attorney, Agent, or Firm* — Finnegan, Henderson, Farabow, Garrett & Dunner LLP

(57) ABSTRACT

The present invention relates to a tube cutting knife monitoring system for a filling machine for manufacturing packages from a tube, the filling machine comprising a tube cutting knife (18) and a hydraulic system (20) adapted to actuate the tube cutting knife, wherein the monitoring system comprises: a pressure sensor (22) adapted to detect hydraulic pressure of the hydraulic system when the tube cutting knife is cutting the tube; and a logging system (26) adapted to log the hydraulic pressure detected by the pressure sensor.

5 Claims, 4 Drawing Sheets

CUTTING KNIFE MONITORING SYSTEM FOR A FILLING MACHINE

CROSS-REFERENCE TO RELATED PATENT APPLICATIONS

This is a National Phase of International Application No. PCT/EP2016/081037, filed Dec. 14, 2016, which claims the benefit of Swedish Application No. 1551679-2 filed Dec. 18, 2015. The entire contents of the above-referenced applications are expressly incorporated herein by reference.

FIELD OF THE INVENTION

The present invention relates to a tube cutting knife monitoring system for a filling machine for manufacturing packages from a tube. The present invention also relates to a filling machine comprising such a system. The present invention also relates to a method of monitoring wear of a tube cutting knife in a filling machine.

BACKGROUND

A filling machine for manufacturing packages from a tube typically comprises tube cutting knifes adapted to cut the tube, and a hydraulic system adapted to actuate the tube cutting knifes. The tube cutting knifes may be changed based on running hours. However, this could lead to knifes being changed too early or too late. The former could mean that the knife is not utilized enough. The latter could disturb or interrupt the production, and affect the aseptic performance in the filling machine in case of an aseptic filling machine.

SUMMARY OF THE INVENTION

It is an object of the present invention to overcome or at least alleviate the above-mentioned drawbacks.

According to a first aspect of the invention, where is provided a tube cutting knife monitoring system for a filling machine for manufacturing packages from a tube, the filling machine comprising a tube cutting knife and a hydraulic system adapted to actuate the tube cutting knife, wherein the monitoring system comprises: a pressure sensor adapted to detect hydraulic pressure of the hydraulic system when the tube cutting knife is cutting the tube; and a logging system adapted to log the hydraulic pressure detected by the pressure sensor.

The present invention is based on the understanding that it is possible to monitor wear of the tube cutting knife by detecting (and logging) hydraulic pressure of the hydraulic system that actuates the tube cutting knife. That is, the detected hydraulic pressure indicates the wear of the tube cutting knife. In this way, it is possible to avoid interruption in the production and in a long term risk for unsterile packages. Furthermore, it may give a better supervision of the condition for the tube cutting knife. It may be possible to use the tube cutting knife optimally, and it may is also possible to get statistics over life span and get online information of the performance of the tube cutting knife.

The logging system may be configured to indicate that the tube cutting knife is worn out if the detected hydraulic pressure when the tube cutting knife cuts through the tube exceeds a predetermined threshold. That is, when the tube cutting knife starts to be worn out the hydraulic pressure increases. The logging system may for example activate an alarm when the detected hydraulic pressure exceeds the predetermined threshold. The predetermined threshold may for example be established though experiments or tests.

The detected hydraulic pressure may be a hydraulic pressure profile.

According to a second aspect of the invention, there is provided a filling machine for manufacturing packages from a tube, comprising: a tube cutting knife; a hydraulic system adapted to actuate the tube cutting knife; and a tube cutting knife monitoring system according to the first aspect. This aspect may exhibit the same features and/or technical effects as the first aspect.

According to a third aspect of the invention, there is provided a method of monitoring wear of a tube cutting knife in a filling machine for manufacturing packages from a tube, wherein the filling machine comprises a hydraulic system adapted to actuate the tube cutting knife, and wherein the method comprises: detecting hydraulic pressure of the hydraulic system when the tube cutting knife is cutting the tube, wherein the detected hydraulic pressure indicates the wear of the tube cutting knife. This aspect may exhibit the same features and/or technical effects as the first and/or second aspect, and vice versa. The method may be repeated until the detected hydraulic pressure indicates the tube cutting knife is worn out.

The method may further comprise: logging the detected hydraulic pressure.

The method may further comprise: indicating that the tube cutting knife is worn out if the detected hydraulic pressure when the tube cutting knife cuts through the tube exceeds a predetermined threshold.

The detected hydraulic pressure may be a hydraulic pressure profile.

BRIEF DESCRIPTION OF THE DRAWINGS

These and other aspects of the present invention will now be described in more detail, with reference to the appended drawings showing one or more embodiments of the invention.

DETAILED DESCRIPTION OF THE INVENTION

Figure 1:
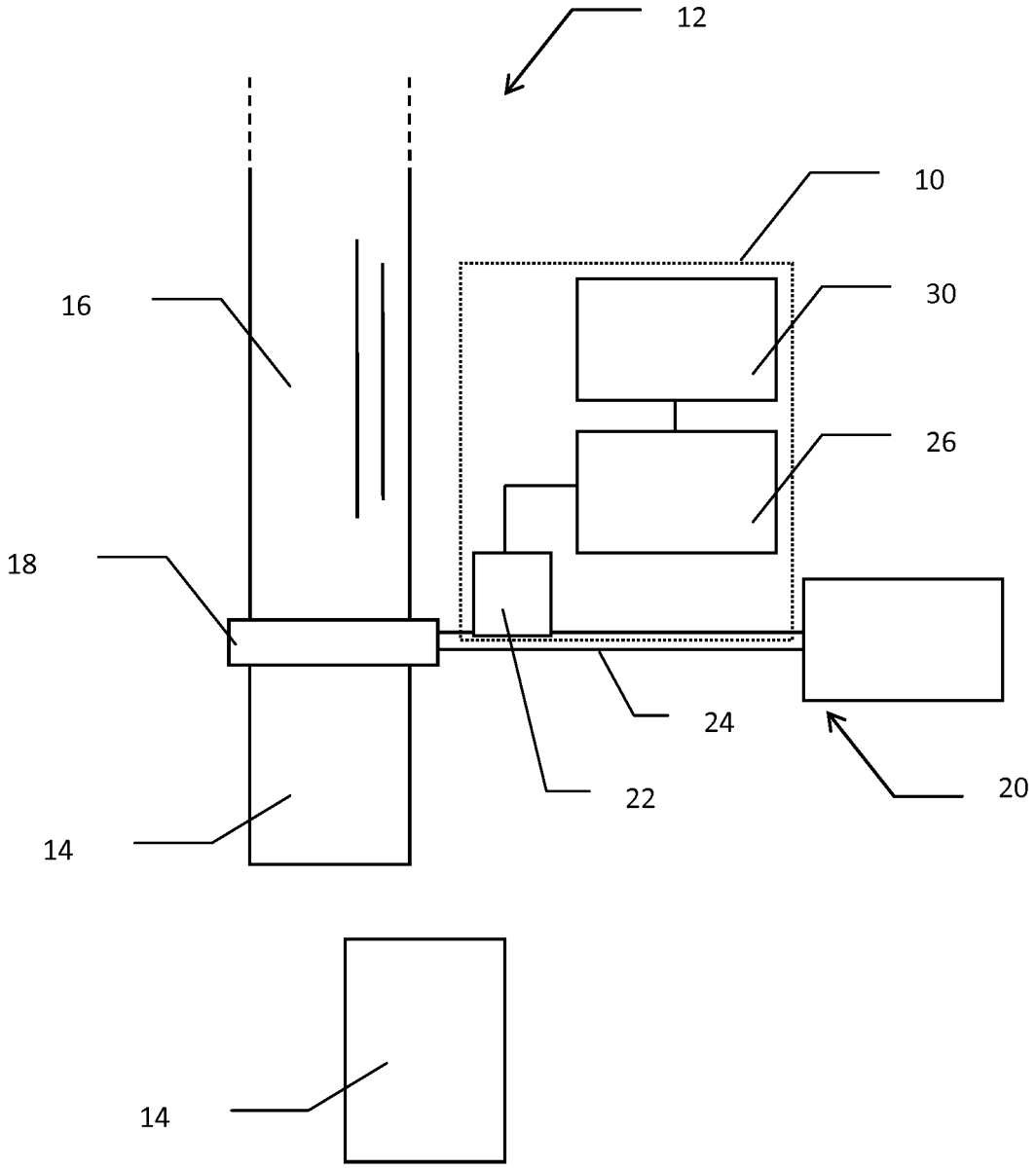
FIG. 1 schematically illustrates a tube cutting knife monitoring system for a filling machine according to an embodiment of the present invention.

FIG. 1 schematically illustrates a tube cutting knife monitoring system 10 for a filling machine 12 according to an embodiment of the present invention.

The filling machine 12 is adapted to fill and manufacture packages 14 from a continuous tube 16 of packaging material. The filling machine 12 may for example be Tetra Pak TBA/8. The filling machine 12 may be an aseptic filling machine. The system 10 can also be used in a filling machine running pasteurized products.

The filling machine 12 comprises a tube cutting knife 18. The tube cutting knife 18 is utilized to cut or separate the continuous tube 16 into individual packages 14, for example in connection with sealing of the tube 16. The filling machine 12 further comprises a hydraulic system 20. The hydraulic system 20 adapted to actuate the tube cutting knife 18.

The monitoring system 10 comprises a pressure sensor 22. The pressure sensor 22 may for example be attached to a hydraulic pipe 24 of the hydraulic system 20. The pressure sensor 22 adapted to detect hydraulic pressure of the hydraulic system 20 when the tube cutting knife 18 is cutting the tube 16.

The monitoring system 10 further comprises a logging system 26. The logging system 26 is connected (wired or wireless) to the pressure sensor 22. The logging system 26 is adapted to log or record the hydraulic pressure detected by the pressure sensor 22. The logging system 26 may use an electrical signal from an electrical hydraulic valve of the hydraulic system 20 as a trig signal to start the logging. The monitoring system 10 may comprise a computer, logic circuit or other intelligence for analyzing the pressure signal.

Figure 2:
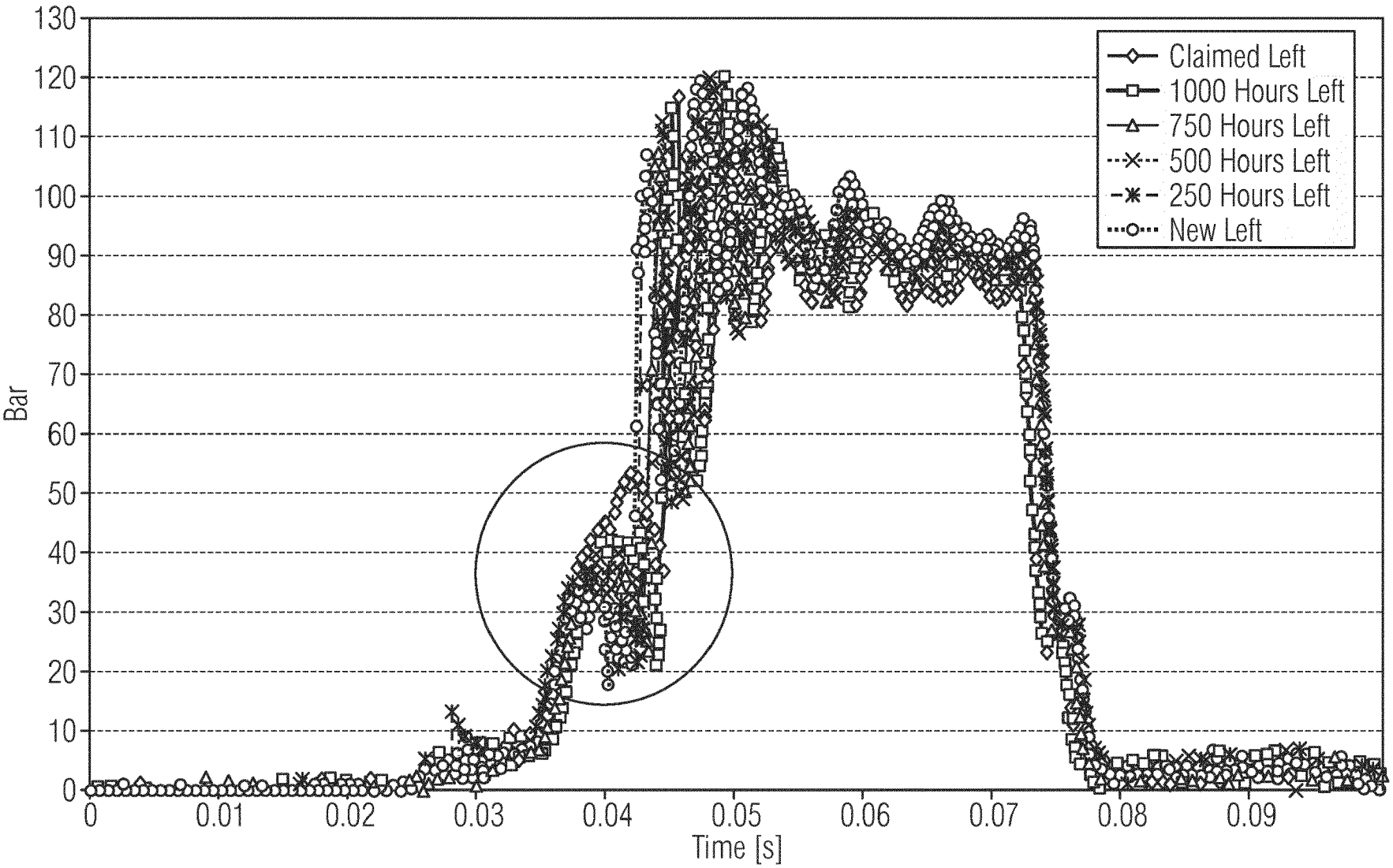
FIG. 2 shows hydraulic pressure over time.
Figure 3:
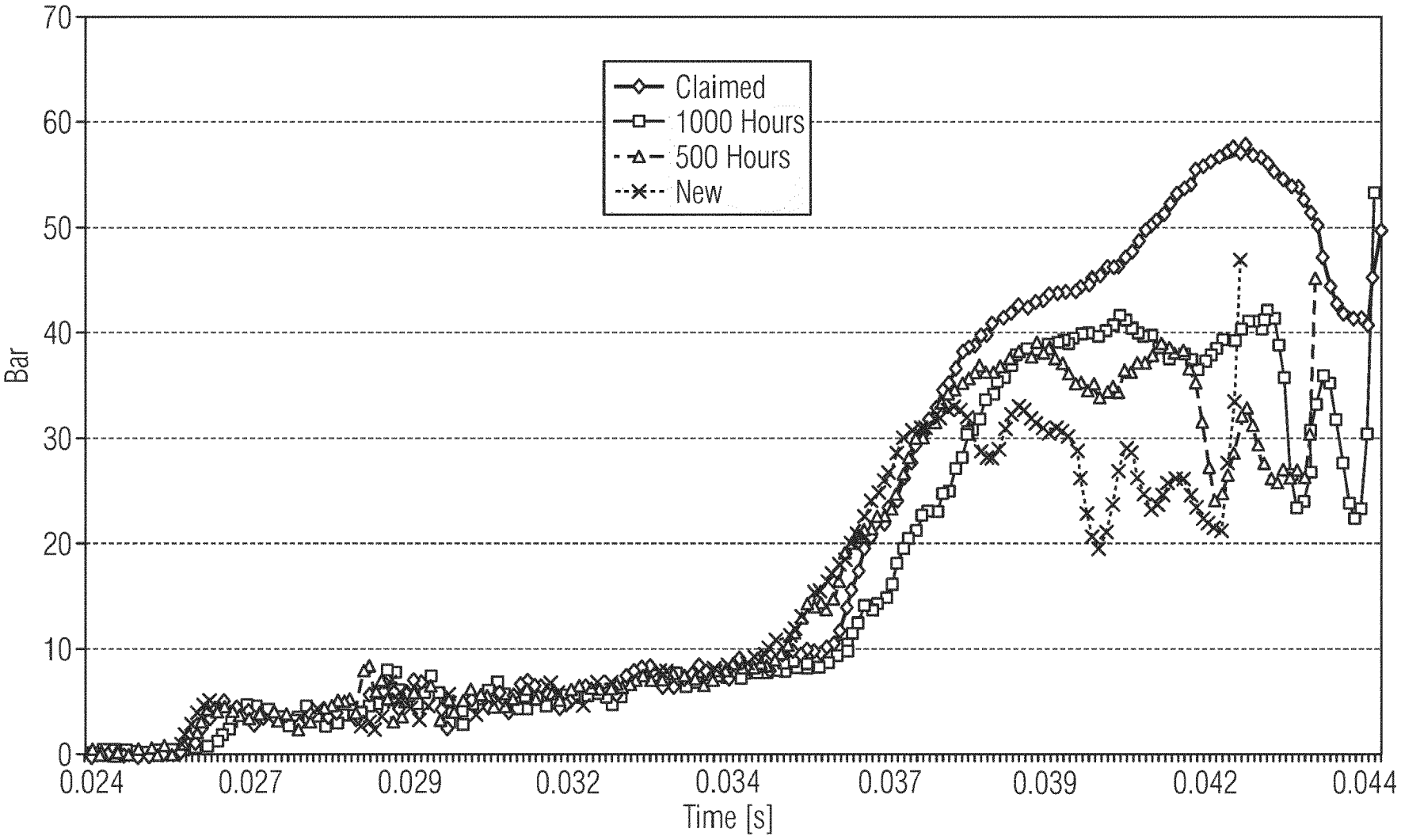
FIG. 3 shows hydraulic pressure over time when the knife is passing through the tube.

Examples of hydraulic pressures detected by the pressure sensor 22 for tube cutting knives with different running hours are shown in FIG. 2. Also, new and claimed knives are shown in FIG. 2. The detected hydraulic pressure has a profile ('hydraulic pressure profile'). The circle in FIG. 2 shows the portion of the hydraulic pressure profile when the tube cutting knife 18 cuts through the tube. Said portion may be described as an initial, local maximum before the main peak pressure of the profile. As further shown in FIG. 3, the hydraulic pressure increases with running hours. To this end, the logging system 26 may be configured to indicate that the tube cutting knife 18 is worn out and needs replacement if the detected hydraulic pressure when the tube cutting knife 18 cuts through the tube 16 exceeds a predetermined threshold.

The monitoring system 10 may further comprise an alarm 30 connected to the logging system 26. The alarm 30 may be activated then the logging system 26 indicates that the tube cutting knife 18 is worn out. The alarm 30 could for example be a visual alarm, an audible alarm, a message sent to an operator of the filling machine 12, etc.

Further, the monitoring system 10 may be connected to a remote entity (not shown) to provide online information of the performance of the tube cutting knife 18.

Figure 4:
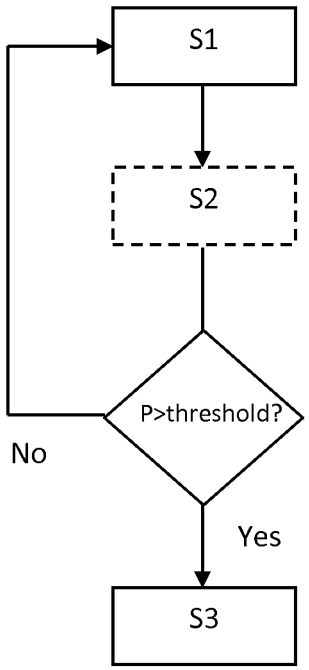
FIG. 4 is a flow chart of a method according to an embodiment of the present invention.

A method of monitoring wear of the tube cutting knife 18 in the filling machine 12 according to an embodiment of the invention will now be described with reference to FIG. 4. The method may be performed using the monitoring system 10.

In step S1, hydraulic pressure of the hydraulic system when the tube cutting knife 18 is cutting the tube 16 is detected. The detected hydraulic pressure indicates the wear of the tube cutting knife 18.

The detected hydraulic pressure may be logged in step S2.

If the detected hydraulic pressure exceeds a predetermined threshold when the tube cutting knife cuts through the tube, the method may indicate that the tube cutting knife 18 is worn out in step S3. The method may for example activate an alarm that the tube cutting knife 18 should be replaced. If the detected hydraulic pressure does not exceed the predetermined threshold, step S1 and (optionally) step S2 may be repeated.

The person skilled in the art realizes that the present invention by no means is limited to the preferred embodiments described above. On the contrary, many modifications and variations are possible within the scope of the appended claims. For example, the filling machine 12 can comprise at least one additional tube cutting knife that may be monitored. The filling machine 12 may for example comprise a left side tube cutting knife and a right side tube cutting knife. To this end, the monitoring system 10 may comprise at least one pressure sensor per tube cutting knife, wherein each pressure sensor is connected to the logging system, so that the monitoring system may detect the hydraulic pressure of both sides (or of all knives if the filling machine comprises more than two knives).

The invention claimed is:

1. A tube cutting knife monitoring system for a filling machine that includes a tube cutting knife and a hydraulic system adapted to actuate the tube cutting knife and that is configured to manufacture packages from a tube, the tube cutting knife monitoring system comprising:

a pressure sensor adapted to detect hydraulic pressure of the hydraulic system when the tube cutting knife is cutting the tube; and a logging system adapted to log the hydraulic pressure detected by the pressure sensor over a time period so as to form a hydraulic pressure profile, wherein the logging system is configured to indicate that the tube cutting knife is worn out if the detected hydraulic pressure, when the cutting knife cuts through the tube, exceeds a predetermined threshold.

2. A filling machine for manufacturing packages from a tube, comprising the knife monitoring system according to claim 1.

3. A method of monitoring wear of a cutting knife in a filling machine for manufacturing packages from a tube, the method comprising:

actuating, by a hydraulic system, the cutting knife to cut the tube;

detecting hydraulic pressure of the hydraulic system when the cutting knife is cutting the tube;

logging the hydraulic pressure over a time period so as to form a hydraulic pressure profile, and if the detected hydraulic pressure exceeds a predetermined threshold, determining that the cutting knife is worn based on the detected hydraulic pressure.

4. The tube cutting knife monitoring system of claim 1, wherein the logging system is configured such that the detected hydraulic pressure is detected during a portion of the hydraulic pressure profile corresponding to a local maximum before a peak pressure of the hydraulic pressure profile when the cutting knife cuts through the tube.

5. The method of claim 3, wherein the detected hydraulic pressure is detected during a portion of the hydraulic pressure profile corresponding to a local maximum before a peak pressure of the hydraulic pressure profile when the cutting knife cuts through the tube.

* * * * *